US005483809A

United States Patent [19]

Nishiie et al.

[11] Patent Number: 5,483,809

[45] Date of Patent: Jan. 16, 1996

[54] PROCESS FOR BENDING A METAL TUBE TO A SMALL RADIUS OF CURVATURE AND A BENT METAL TUBE

[75] Inventors: Katsuhiko Nishiie, Fuji; Akira Kubono, Mishima, both of Japan

[73] Assignee: Usui Kokusai Sangyo Kaisha Ltd., Japan

[21] Appl. No.: 196,399

[22] Filed: Feb. 15, 1994

[30] Foreign Application Priority Data

Feb. 15, 1993 [JP] Japan ..... 5-048549

[51] Int. Cl.[6] ..... B21D 9/05; B21D 9/01

[52] U.S. Cl. ..... 72/150; 72/310; 72/369

[58] Field of Search ..... 72/150, 152, 310, 72/319, 321, 350, 352, 369

[56] References Cited

U.S. PATENT DOCUMENTS

| | | | |
|---|---|---|---|
| 2,873,786 | 2/1959 | Fuchs, Jr. | 72/150 |
| 2,976,908 | 3/1961 | Ferguson | 72/150 |
| 2,996,100 | 8/1961 | Newhall et al. | 72/369 |
| 4,959,984 | 10/1990 | Trudell et al. | 72/150 |
| 5,129,247 | 7/1992 | Johnson | 72/133 |

FOREIGN PATENT DOCUMENTS 3297517 of 0000 Japan .

*Primary Examiner*—Lowell A. Larson
*Assistant Examiner*—Rodney Butler
*Attorney, Agent, or Firm*—Anthony J. Casella; Gerald E. Hespos

[57] ABSTRACT

A bent metal tube of high quality having a bend formed with a small radius of curvature, and not having any flattened, cracked, broken, folded, or otherwise defective wall portion, and a bending process which can make the same efficiently. The tube has along the inside corner of its bend a thickened wall portion having a thickness of 2.0 t to 1.5 t (t is the wall thickness of work), and a pair of transitory wall portions formed on both sides, respectively, of the thickened wall portion, and each having a gradually decreasing thickness approaching the wall thickness t of the work, and a length which is at least equal to ⅓ D (D is the diameter of the work), while the bend has an outer peripheral configuration which is substantially equal to that of the work. The bent tube is formed from the work secured near one end thereof by a first clamp consisting of a pair of members and having a pipe guide groove, while the work is fitted about a core positioned in the guide groove and having an end defining a guide surface. The work is loosely held near the other end thereof by a second clamp consisting of a pair of members and having a guide groove in which the work is loosely fitted. The second clamp is rotated, while the work is axially pushed at the other end thereof by a pressure cylinder, whereby the work is bent along the guide surface and the guide groove.

11 Claims, 6 Drawing Sheets

PRIOR ART

PROCESS FOR BENDING A METAL TUBE TO A SMALL RADIUS OF CURVATURE AND A BENT METAL TUBE

BACKGROUND OF THE INVENTION

1. Field of the Invention

This invention relates to a process for bending a tubular piece of work to form a bent metal tube having a small radius of curvature, and to a bent metal tube of high quality made preferably-by that process, and having no flattening, crack, break or other defect of the nature formed in its bent portion by the concentration of stress in the tube.

2. Description of the Prior Art

The increasing use of small parts for the engine room, or cooler mechanism of an automobile, etc. has brought about a demand for bent metal tubes having a small radius of curvature for connecting the parts arranged with a high packing density. A bent metal tube having a relatively large radius of curvature can be manufactured if work is clamped at one end, and pressed against a bending die. If this manufacturing process is used for bending a tubular piece of work to a radius of curvature which is smaller than its diameter, however, it has been likely that the work may slip back at its clamped end during the rotation of the bending die, and form a bent metal tube flattened by the failure of its bent portion to maintain its circular cross section, or a bent tube having a folded or collapsed wall portion along the inner center of its curvature, or a broken wall portion along the outer center thereof.

FIG. 11 shows examples of defectively bent metal tubes: (*a*) one having a flattened wall portion α along the outer corner of its bend, (*b*) one having a cracked wall portion β along the outer corner of its bend, and (*c*) one having a collapsed wall portion γ along the inner corner of its bend. While the tube having the cracked wall portion is, of course, undesirable as it allows a fluid to leak out, the tube having the flattened or collapsed wall portion α or γ is also undesirable, since it gives a greater resistance to the flow of a fluid therethrough, and the concentration of stress in the collapsed wall portion is likely to cause it to crack.

It has, therefore, been usual to manufacture a bent metal tube or pipe by cutting one end of each of two pipes at an angle of 45°, and welding the cut ends thereof together. The manufacture of a bent tube in this way has, however, had the drawbacks of calling for a long time because of a series of steps including oblique cutting, welding and leakage testing, and of yielding a bent tube which is likely to give resistance and a pressure loss to a fluid flowing through its right-angled joint, as well as allowing the fluid to leak out through its welded joint.

SUMMARY OF THE INVENTION

Under these circumstances, it is an object of this invention to provide a bending process which can form a bent metal tube of high quality having a small radius of curvature without causing any flattening or folding in its bent portion, .and also to provide a bent metal tube of high quality having a bent portion formed with a small radius of curvature, but free from any flattening, cracking, collapsing, or like defect.

According to a first aspect of this invention, the above object is attained by a process which comprises securing work near one end thereof by a first clamp composed of a pair of members and having a pipe guide groove, and a core positioned in the guide groove and having an end defining a guide surface, the work being fitted about the core, holding the work near the other end thereof by a second clamp composed of a pair of members, supported rotatably with respect to the first clamp, and having a guide groove which extends from the guide groove of the first clamp coaxially therewith, and in which the work is loosely fitted, and rotating the second clamp, while pushing the other end of the work axially by a push rod along the guide groove of the second clamp, whereby the work is bent. The core may be inserted either through the first clamp, or through the second clamp, and the work may have a radially outward protrusion formed near one end thereof, while the first clamp has a recess in which the protrusion can be fitted.

According to a second aspect of this invention, the above object is attained by a bent metal tube having a bend formed with an inside bending radius $R \leqq D/2$, where D is the outside diameter of work, and a bending angle θ of 60° to 120°, the bend having along its inside corner a thickened wall portion having a thickness as defined below, and a pair of transitory wall portions spaced apart from each other by the thickene-d..wall portion, and each having a thickness gradually approaching the wall thickness t of the work, and a length which is at least equal to ⅓ D, while the bend has an outer peripheral configuration which is substantially equal to that of the work:

$$2.0\ t \geqq T_2 \geqq 15\ t$$

where $T_2$: the thickness of the thickened wall portion (mm);

t: the wall thickness of the work (mm).

According to the bending process covered by the first aspect of this invention, the work is secured near one end thereof about the core having a guide surface at its end by the first clamp having a pipe guide groove, while it is loosely held near the other end thereof by the second clamp having a guide groove, and the second clamp is rotated, while the other end of the work is pushed by a pressure cylinder along the guide groove of the second clamp, whereby the work is bent with a small radius of curvature along the guide surface of the core. A large compressive force which is produced axially of the work, or tube from the other end thereof to its bent portion brings about an increase in wall thickness of the bent portion by plastic flow, and thereby makes it possible to eliminate the fear of any flattening, cracking, breaking, etc., and obtain a bent tube of high quality.

The bent metal tube made by the process as described above has a bend formed with an inside bending radius $R \leqq D/2$, where D is the outside diameter of work, and a bending angle θ of 60° to 120°, and the bend has along its inside corner a thickened wall portion having a thickness as defined below, and a pair of transitory wall portions spaced apart from each other by the thickened wall portion, and each having a thickness gradually approaching the wall thickness t of the work, and a length which is at least equal to ⅓ D, while the bend has an outer peripheral configuration which is substantially equal to that of the work:

$$20\ t \geqq T_2 \geqq 1.5\ t$$

where $T_2$: the thickness (mm) of the thickened wall portion;

t: the wall thickness (mm) of the work.

DETAILED DESCRIPTION OF PREFERRED EMBODIMENTS

The bending process of this invention will now be described with reference to FIGS. 1 to 9.

Figure 1:
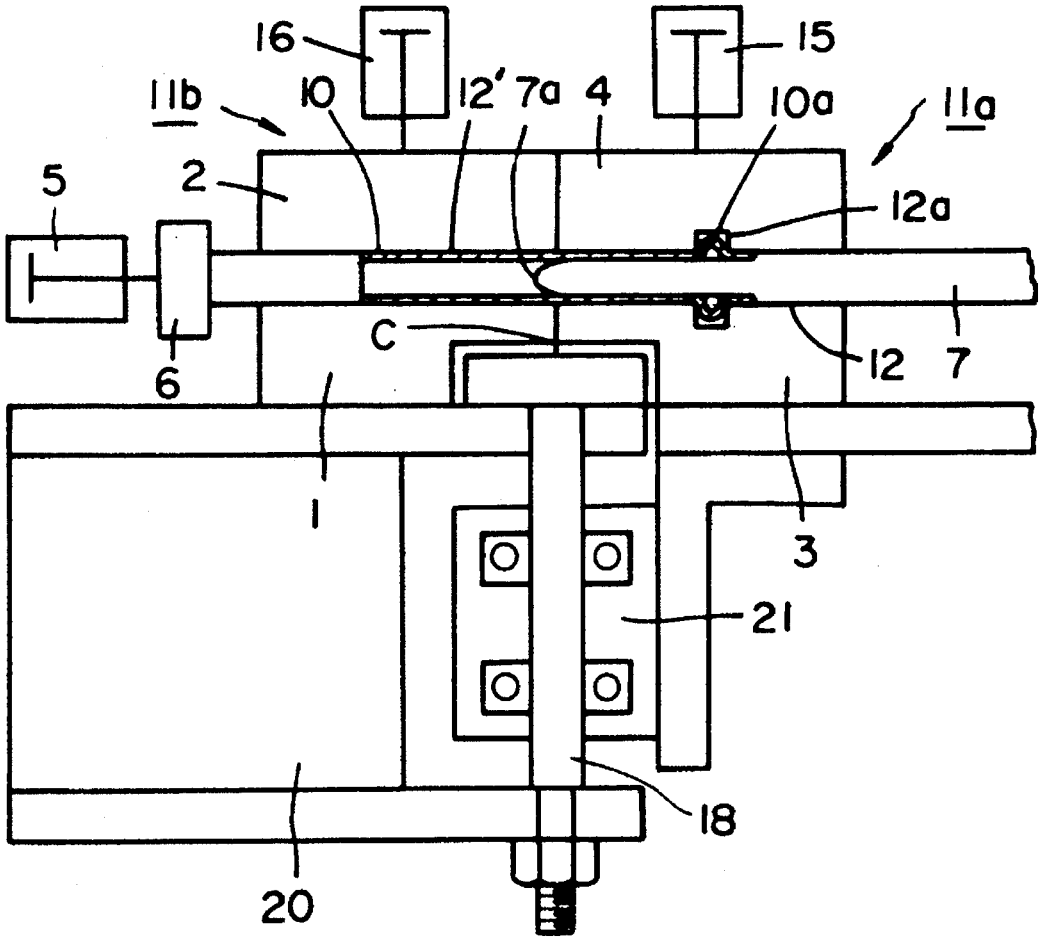
FIG. 1 is a top plan view showing work prior to bending by a first example of the bending process of this invention.

According to a first mode of carrying out the process as shown in FIG. 1, a first clamp 11*a* is defined by a lower die 3 and an upper die 4 and has a pipe guide groove 12, while a second clamp 11*b* is defined by a lower die 1 and an upper die 2 and has a pipe guide groove 12' extending from the pipe guide groove 12 coaxially therewith, and the first clamp 11*a* has a recess 12*a* formed around the pipe guide groove 12. A tubular piece of work 10 to be bent has a protrusion 10*a* in the form of e.g. a spool or flare near one end thereof, and is set in the pipe guide groove 12 with its protrusion 10*a* fitted in the recess 12*a*, while it is fitted about a core 7 installed in the first clamp 11*a* and having an end projecting from it and beyond the boundary plane between,the first and second clamps 11*a* and 11*b*, and defining a guide surface 7*a*. The work 10 is held in position under pressure by a cylinder 15 connected to the first clamp 11*a*, or by the core 7 about which it is fitted, while near the other end thereof, the work 10 is loosely held in the guide groove 12' by a cylinder 16 connected to the second clamp 11*b*.

A push rod 6 faces the other end of the work 10 and can be pushed by a push cylinder 5. The second clamp 11*b* is mounted rotatably about the center C of rotation which is defined along an edge of the plane in which it mates with the first clamp 11*a*. A rotating body 20 having a rotating shaft 18 aligned with the center C of rotation is secured to the second clamp 11*b*, and the rotating shaft 18 is rotatably supported by bearings 21 secured to the first clamp 11*a*.

Figure 2A:
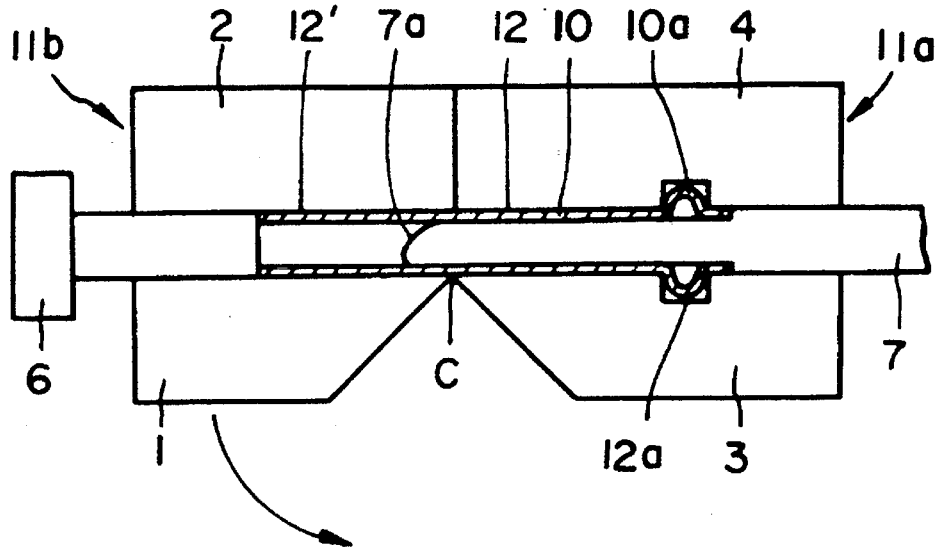
FIGS. 2(*a*) and 2(*b*) are views for explaining the bending of the work by the first example of the process as shown in FIG. 1, FIG. 2(*a*) being a front elevational view showing the work prior to bending, while FIG. 2(*b*) is a view showing the work as bent.
Figure 2B:
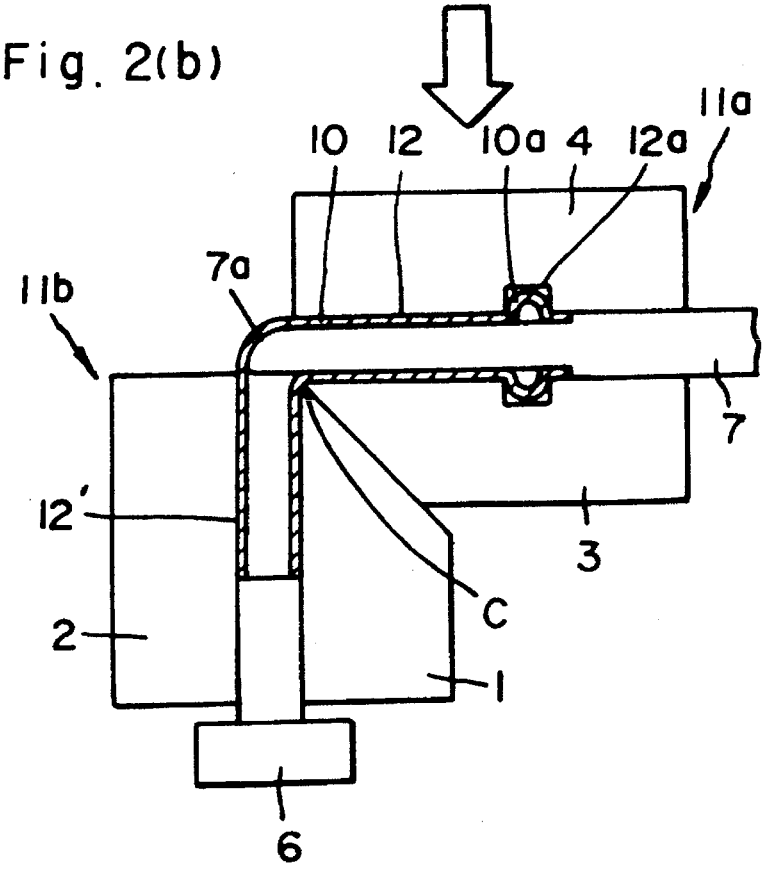

If the rotating shaft 18 is rotated to rotate the rotating body 20, while the push cylinder 5 is driven to cause the push rod 6 to push the work 10 at the other end thereof, the second clamp 11*b* is rotated about the center C of rotation with respect to the first clamp 11*a*. Referring to FIG. 2, the rotation of the rotating body 20 causes the second clamp 11*b* fixed to it to rotate from its position shown in FIG. 2(*a*) to, for example, its position shown in FIG. 2(*b*) if the manufacture of a tube bent at an angle of 90° is intended. As the work 10 has one end secured by the first clamp 11*a*, while the other end thereof is constantly pushed by the push rod 6, it is bent along the guide groove 12' of the second clamp 11*b*, while its inner wall surface is guided by the guide surface 7*a* of the core 7. As the other end of the work is constantly pushed by the push rod 6 along the guide groove 12' of the second clamp 11*b*, an axial force acting constantly upon the wall of a bend formed on the work 10 gives it an increased thickness as a result of the plastic flow of its material, so that it may be possible to manufacture efficiently a bent product of high quality having a bend formed with a small radius of curvature, and not having any flattened, cracked or broken wall portion.

Figure 4:
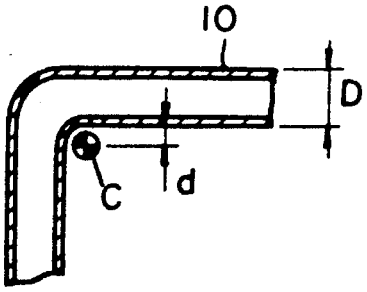
FIG. 4 is a view for explaining the center of rotation as set for another mode of carrying out the bending process of this invention.

Although the first mode of carrying out the process has been described as employing the center C of rotation which is defined on the periphery of the work 10 along the edge of the mating plane between the first and second clamps 11*a* and 11*b*, it is also possible to space the center C of rotation apart from the periphery of the work 10. If the center C of rotation is spaced apart from the work 10 as shown in FIG. 4, the distance d between the periphery of the work 10 and the center C of rotation should not exceed ½ of the diameter D of the work 10, and is preferably not greater than ¼ of D. We, the inventors of this invention, have experimentally found that it is possible to make a bent tube of the highest quality when $(1/20)D \leqq d < (1/8)D$.

Figure 3:
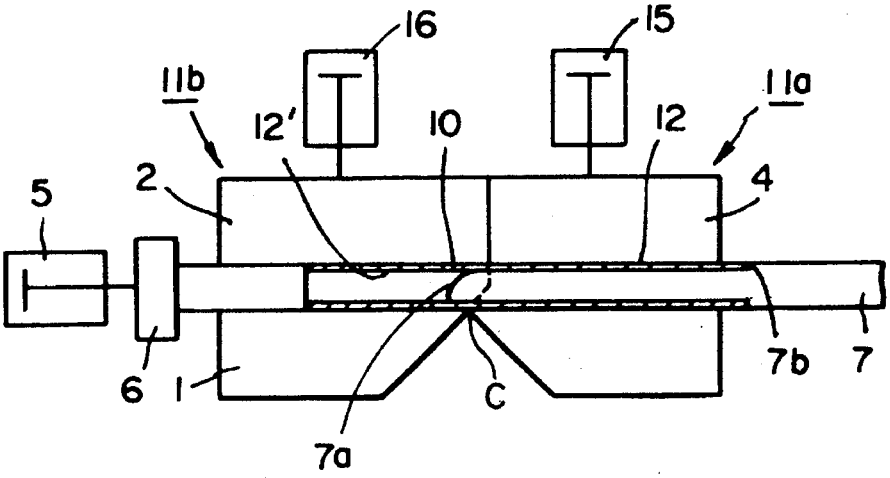
FIG. 3 is a front elevational view showing work prior to bending by a second example of the bending process of this invention.

A second mode of carrying out the process of this invention is applied to work having no spool, as shown in FIG. 3. The work 10 which is set in the pipe guide grooves 12 and 12' of a first and a second clamp 11*a* and 11*b*, respectively, has a portion positioned and held tightly in the first clamp 11*a*. A core 7 is inserted into the work 10 until its shoulder 7*b* abuts on one end of the work 10, and its guide surface 7*a* projects beyond the boundary plane between the first and second clamps 11*a* and 11*b*, as is the case with the first mode.

Then, the second clamp 11*b* is rotated about the center C of rotation with respect to the first clamp 11*a*, while the work 10 is constantly pressed by a push rod 6, so that the axial force of the push rod 6 may cause the plastic flow of the work material and thereby make it possible to bend the work 10 smoothly, as is the case with the first mode.

Although it has been explained with reference to FIG. 3 that the core 7 is positioned by insertion into the work 10 until its shoulder 7*b* abuts on the end of the work 10, it is also possible to employ another positioning means not shown to position the core 7 in place.

Thus, it is possible to obtain the same results from the second mode employing the work 10 having no spool as from the first mode described before.

The first mode is suitable for bending a relatively short piece of work 10, while the second mode is suitable for bending a relatively long piece of work 10, but it is also possible to employ the second mode for bending a short piece of work 10 and the first mode for bending a long piece of work 10.

We have experimentally found that it is possible to manufacture a bent tube of high quality which is least likely to have any flattened or folded wall portion in its bend, if the second clamp 11*b* is so shaped as to cover about a half of the outer corner of the bend formed in the work 10 when it is bent.

Figure 5:
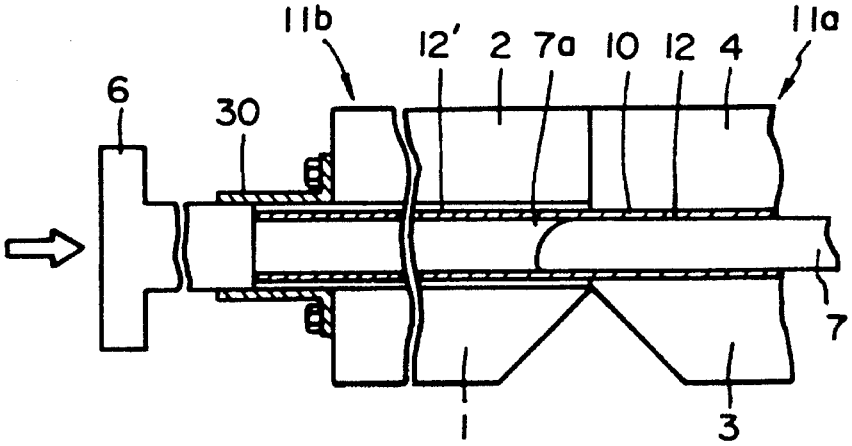
FIG. 5 is a view showing a push rod which is used for carrying out a fourth example of the process of this invention.
Figure 6:
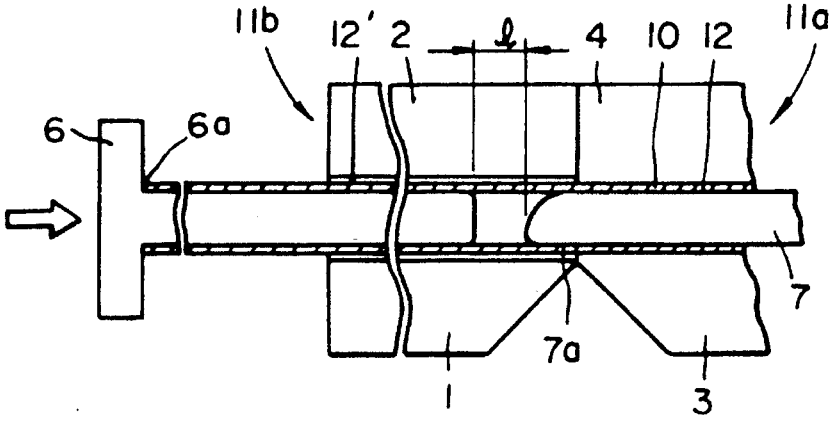
FIG. 6 is a view showing a push rod which is used for carrying,out a fifth example of the process of this invention.
Figure 7:
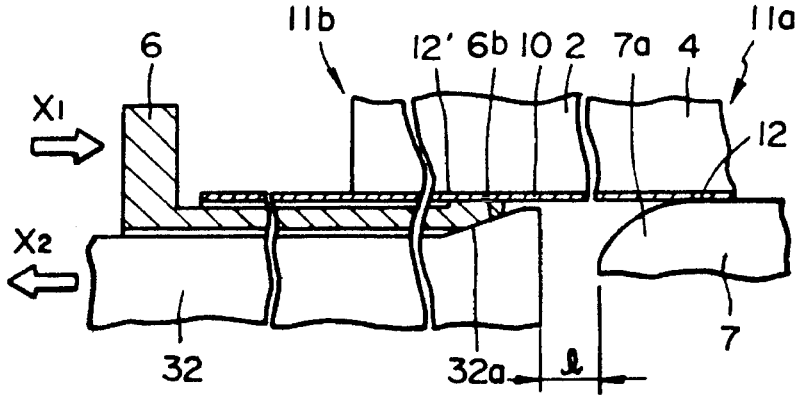
FIG. 7 is a view showing a push rod which is used for carrying out a sixth example of the process of this invention.

Third to fifth modes employ different forms of push rod 6 as shown in FIGS. 5 to 7. FIG. 5 shows the mode in which the work 10 is slightly projected from the second clamp 11*b* when it is bent, and which employs a sleeve 30 secured to the second-clamp 11*b* so as to contact the outer periphery of a push rod 6. The sleeve 30 enables the push rod 6 to be advanced correctly in the direction of the axis of the work 10.

FIG. 6 shows the mode in which the work 10 has a long portion projecting from the second clamp 11*b* when it is bent, and which employs a push rod 6 having a long shank which is inserted into the work 10 in the second clamp 11*b* substantially along its entire length, but terminates ahead of the end of a core 7 to leave a bending allowance l for the work 10. The push rod 6 has a shoulder 6*a* which exerts an axial pressure on the work 10.

FIG. 7 shows a cylindrical push rod 6 having a frustoconical inner peripheral surface 6*b* giving a gradually increasing bore diameter toward its inner end, and a pull rod 32 extending through the push rod 6 and having a frustoconical outer peripheral surface 32*a* toward its inner end. The push and pull rods 6 and 32 are inserted into the work 10 and the push rod 6 has around its inner end an outer peripheral surface contacting the inner peripheral surface of the work 10. The rods 6 and 32 extend substantially along the entire length of the work 10 in the second clamp 11*b*, while leaving a bending allowance l for the work 10. If the push rod 6 is pushed in the direction of an arrow $X_1$, while the pull rod 32 is pulled in the direction of an arrow $X_2$, the frustoconical surfaces 6*b* and 32*a* are pressed by each other, and the work 10 is axially pressed by the outer peripheral surface of the push rod 6 around its inner end.

Figure 8:
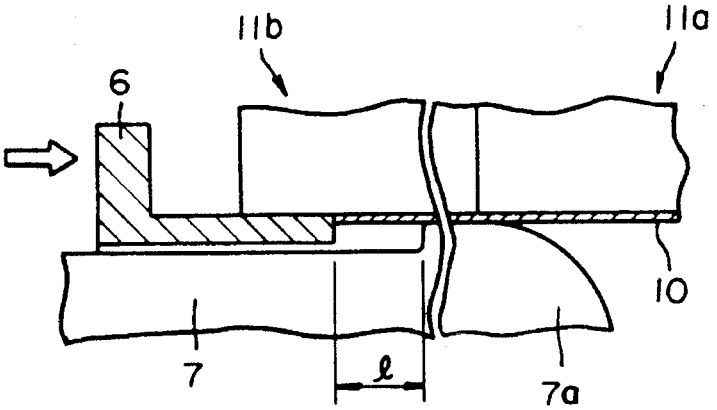
FIG. 8 is a fragmentary front elevational view showing the essential feature of a seventh example of the bending process of this invention.

A sixth mode of carrying out the process employs a cylindrical push rod 6 and a core 7 which is inserted into work 10 through a second clamp 11*b*, as shown in FIG. 8. It is identical in any other respect to the first mode as hereinbefore described, and can produce the same results as the first mode.

Figure 9:
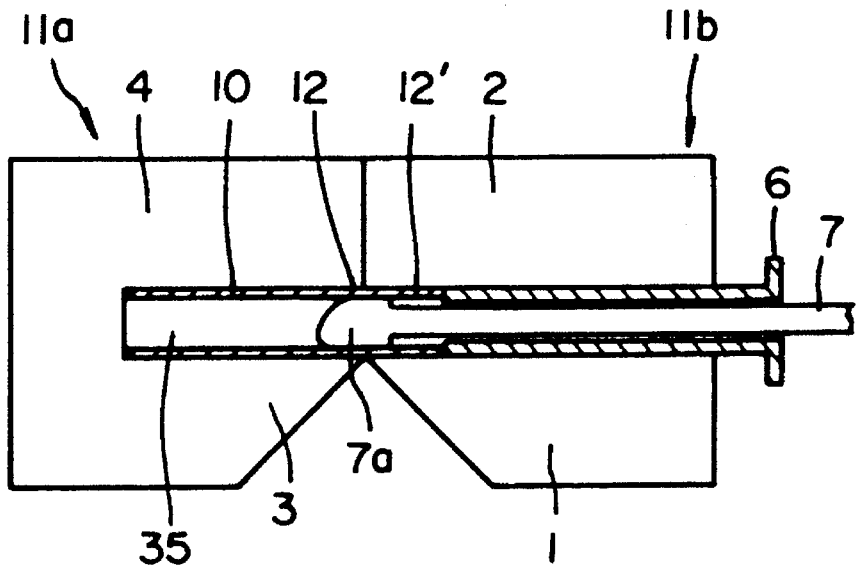
FIG. 9 is a front elevational view showing the essential feature of an eighth example of the bending process of this invention.

A seventh mode of carrying out the process employs a first clamp 11*a* having a blind bore 35 with a diameter which is slightly larger than the outside diameter of work 10 which is inserted through pipe guide grooves 12 and 12' until one end thereof abuts on the bottom of the blind bore 35, as shown in FIG. 9. The work 10 is, then, bent, while the other end thereof is pressed by a push rod 6.

The seventh mode can produce the same results with the first mode as hereinbefore described by employing a short piece of work 10.

All of the modes as hereinabove described by way of example are easy to carry out by employing a simple apparatus, and yet can manufacture a bent tube of high quality having a bend formed with a small radius of curvature, and not having any flattened, cracked, broken or folded wall portion. They also provide an economical advantage in the cost of manufacture, since they can quickly manufacture a bent metal tube which does not call for any repairing work.

Figure 10:
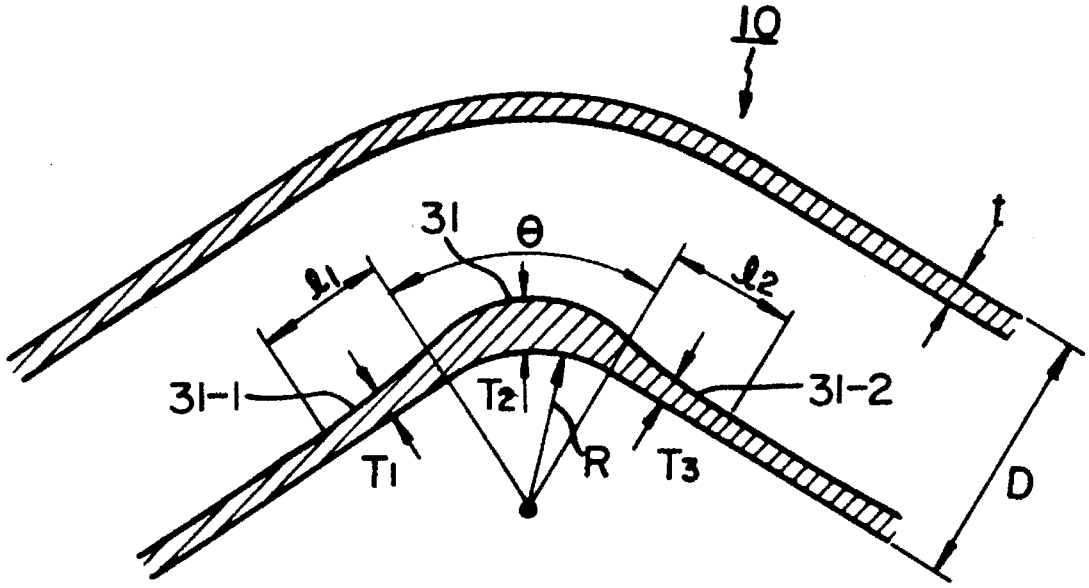
FIG. 10 is a sectional view of a bend for describing a bent metal tube according to this invention.
Figure 11A:
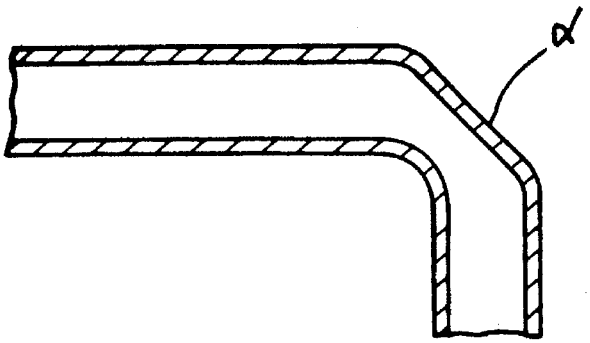
FIGS. 11(*a*) to 11(*c*) are sectional views showing examples of conventional bent metal tubes as defectively formed: (*a*) one having a flattened wall portion along the outer corner of its bend, (*b*) one having a cracked wall portion along the outer corner of its bend, and (*c*) one having a collapsed wall portion along the inner corner of its bend.
Figure 11B:
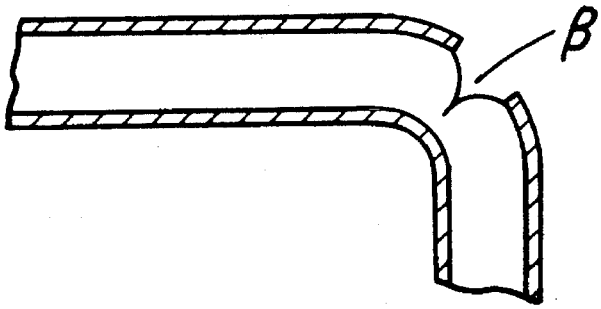
PRIOR ART Fig. 11(b)
Figure 11C:
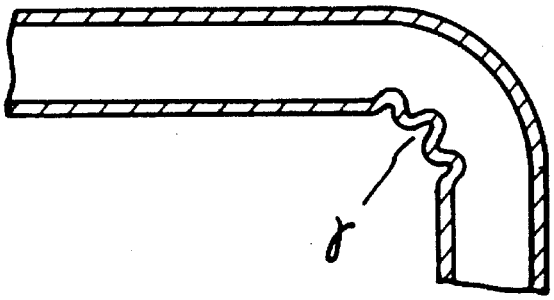
PRIOR ART Fig. 11(c)

Referring now to FIG. 10, description will be made of a bent metal tube according to this invention which can be manufactured by any of a variety of processes, but preferably by any of the modes of carrying out the process of this invention as hereinabove described. A bent piece of work 10 has a thickened wall portion 31 having a thickness $T_2$ along a bend having a bending angle θ of 60° to 120°, and a pair of transitory wall portions 31-1 and 31-2 spaced apart from each other by the thickened wall portion 31, and each having a thickness $T_1$ or $T_3$ gradually decreasing and approaching the wall thickness t of the work 10, and a length $l_1$ or $l_2$ which is at least equal to ⅓ D (D is the outside diameter of the work). The bent tube has an inside bending radius R which is equal to, or smaller than, D/2.

This invention includes the following relationship as an essential feature:

$$2.0\ t \geqq T_2 \geqq 1.5\ t$$

where $T_2$: the thickness (mm) of the thickened wall portion;

t: the wall thickness (mm) of the work.

The thickness $T_2$ of the thickened wall portion 31 is essentially required to fall within the range defined above, since the thickened wall portion 31 creates resistance to the flow of a fluid if its thickness $T_2$ exceeds 2.0 t, while it fails to prevent the concentration of stress (or distribute stress) in the bend if its thickness is smaller than 1.5 t. The transitory wall portions 31-1 and 31-2 are both required to have a length $l_1$ or $l_2$ which is at least equal to ⅓ D, since they fail to distribute stress effectively if their length is smaller than 1/3 D. The thicknesses $T_1$ and $T_3$ of the transitory wall portions 31-1 and 31-2, respectively, are smaller than the wall thickness t of the work, and gradually approach it.

The bent tube of this invention having a bend formed with an inside bending radius R≦D/2 and a bending angle θ of 60° to 120° and therefore having a small or very small radius of curvature can not only minimize any resistance to the flow of a fluid passing therethrough, but also prevent the concentration of stress in its bend which would otherwise be likely to occur because of its small bending radius R, since its bend has a thickened wall portion 31 having a thickness falling within the range of $2.0\ t \geqq T_2 \geqq 1.5\ t$, and a pair of transitory wall portions formed on both sides, respectively, of the thickened wall portion, and each having a thickness gradually approaching the wall thickness t of the work, and a length which is at least equal to ⅓ D, while it has an outer peripheral configuration which is substantially equal to that of the work.

According to the bending process of this invention, the work is held in position by the first clamp near one end thereof, and is loosely held by the second clamp near the other end thereof, while it is fitted about the core, and the second clamp is rotated, while the work is axially pushed at the other end thereof, so that the plastic flow of the work material from the straight portion of the work to its bent portion forms a thickened wall portion along its bent portion, as hereinabove described. The process can, therefore, manufacture a bent metal tube of high quality having a bend formed with a small radius of curvature, and not having any flattened, cracked, broken or folded wall portion, rapidly and efficiently at a low cost.

The bent metal tube of this invention having a small or very small radius of curvature can not only minimize any resistance to the flow of a fluid passing therethrough, but also prevent any concentration of stress from occurring to its bend, since it has along the inner corner of its bend a thickened wall portion satisfying certain requirements, and a pair of transitory wall portions formed on both sides, respectively, of the thickened wall portion, and each having a gradually decreasing thickness approaching the wall thickness of the work, and an appropriate length, while its bend has an outer peripheral configuration which is substantially equal to that of the work. The tube, therefore, has outstandingly high levels of rigidity and durability, and is of great use as a material for, among others, a part for an automobile.

We claim:

1. A process for placing a small radius bend in a metal tube, said tube having opposed first and second ends and a selected bend location intermediate said ends, said process comprising:

securing said tube in a stationary clamp at a location substantially adjacent said selected bend location and between said selected bend location and said first end of said tube;

holding said tube in a movable clamp at a location substantially adjacent said selected bend location and between said selected bend location and said second end of said tube;

providing an elongate core dimensioned to fit within said tube and having an end defining a guide surface substantially conforming to a desired bent shape for said tube;

inserting said core into said tube such that said guide surface is substantially at said selected bend location; and rotating said movable clamp a selected amount around a selected center of rotation and relative to said stationary clamp, while simultaneously exerting axial pressure on said second end of said tube for urging said second end of said tube toward said selected bend location.

2. A process as set forth in claim 1, wherein said core is inserted through said stationary clamp and into said first end of said tube.

3. A process set forth as in claim 1, wherein said core is inserted through said movable clamp and into said first end of said tube.

4. A process as set forth in claim 1, wherein the tube has a radially outward protrusion formed near said first end thereof, while said stationary clamp has a recess in which said protrusion can be fitted, said step of securing said tube in said stationary clamp comprising positioning said outward protrusion in said recess.

5. A process as set forth in claim 1, wherein said tube is bent to define an inner corner and an outer corner, said movable clamp is so shaped as to cover about a half of the outer corner of a bend as formed on the tube.

6. A process as set forth in claim 1, wherein the second end of said tube projects from said movable clamp when the tube is bent.

7. A process as set forth in claim 1, wherein said tube has an outside diameter, said stationary clamp has a blind bore having a diameter which is slightly larger than the outside diameter of the tube and having an end wall, said step of securing said tube in said stationary clamp comprises inserting said first end of said tube into said blind bore until said first end of said tube contacts said end wall of said blind bore.

8. A process as set forth in claim 1, wherein said tube has an outer periphery, said stationary and movable clamps being in abutting relationship to one another along a mating plane substantially at said selected location for said bend prior to moving said movable clamp around said center of rotation, and wherein said step of moving said movable clamp about said center of rotation comprises moving said clamp about a center of rotation located on the outer periphery of the tube along the edge of the mating plane between said clamps.

9. A process as set forth in claim 1, wherein said tube has an outer periphery defining a diameter D, and wherein said movable clamp has a center of rotation spaced apart from the outer periphery of the tube by a distance d which is equal to, or smaller than ½ of the diameter D of the tube.

10. A process as set forth in claim 9, wherein said distance d is equal to, or smaller than, ¼ of said diameter D.

11. A process as set forth in claim 10, wherein said distance d falls within the range of $(1/20)D \leqq d < (1/8)D$.

* * * * *